United States Patent [19]

Seitz et al.

[11] 3,938,446

[45] Feb. 17, 1976

[54] DOOR ASSEMBLIES FOR CLOSING RAIL CAR END OPENINGS

[75] Inventors: Robert F. Seitz, Hazelcrest; William E. Fritz, Hinsdale; Thorvald Madland, Arlington Heights, all of Ill.

[73] Assignee: The Youngstown Steel Door Co., Cleveland, Ohio

[22] Filed: Sept. 6, 1974

[21] Appl. No.: 503,747

[52] U.S. Cl. ..... 105/368 R; 105/378; 105/410; 296/148; 160/200

[51] Int. Cl.[2] ..... B65J 1/22

[58] Field of Search..... 105/368 R, 378, 410, 258, 105/280, 282 P, 294, 295, 305; 296/147, 148, 155; 160/205, 200

[56] References Cited

UNITED STATES PATENTS

| | | | |
|---|---|---|---|
| 382,934 | 5/1888 | Arms | 105/368 UX |
| 701,551 | 6/1902 | Edwards | 105/368 UX |
| 856,775 | 6/1907 | Edman | 105/368 UX |
| 1,086,603 | 2/1914 | Merker | 105/368 UX |
| 1,198,521 | 9/1916 | Brubaker | 105/368 UX |
| 3,513,783 | 5/1970 | Mayfield et al. | 105/378 |
| 3,516,366 | 6/1970 | Bradford et al. | 105/378 |
| 3,677,197 | 7/1972 | Hounshell et al. | 105/378 |
| 3,827,374 | 8/1974 | Winsor | 105/282 P |
| 3,854,425 | 12/1974 | Allen | 105/368 R |

OTHER PUBLICATIONS

Railway Freight Traffic Dec., 1955 – pp. 22 & 23
Mar., 1957 – p. 23.

*Primary Examiner*—M. Henson Wood, Jr.
*Assistant Examiner*—Gene A. Church
*Attorney, Agent, or Firm*—John H. Mulholland

[57] ABSTRACT

A rail car having an interior cavity and an end opening for loading and unloading lading. A pair of door assemblies, each of which includes a plurality of panels, each pivotally movable with respect to the other for closing at least a portion of the end opening. Pivot means for mounting each of the door assemblies are provided to move the door assemblies between their respective open position and closed position. The pivot means are mounted for movement toward and away from the interior of the rail car to permit storage of the door assemblies within the rail car when their panels are folded back upon one another. The means for moving the pivot means include a guide means in the form of a pair of parallel racks and co-operating pinions drivingly mounted on a common manually driven shaft, one rack and co-operating pinion each at the top portion and the bottom portion of the door assembly. The rack and pinions function to keep the top and bottom portions in register as the folded door assemblies move along tracks extending normal the opening into the interior of the car for storage. The pinion driving shafts are manually driven and include pawl means which hold the doors in storage until the pawl is automatically removed from the teeth of its associated pinion upon manual pulling out of the door assembly. Intermediate locking means on the edges of horizontally disposed lading deck members adjacent the opening are provided, as well as a final locking means which includes a plurality of cams pivoted for movement in unison on a common locking shaft. The shaft includes a locking flange by which vertically movable interference means can selectively restrain the locking flange to prevent rotational movement of the locking shaft for unlocking of the doors. A pivoted sealing lug and appropriately positioned adjacent apertures on the lug and member prevent movement of the interference member during transit of the car.

29 Claims, 15 Drawing Figures

FIG. 1
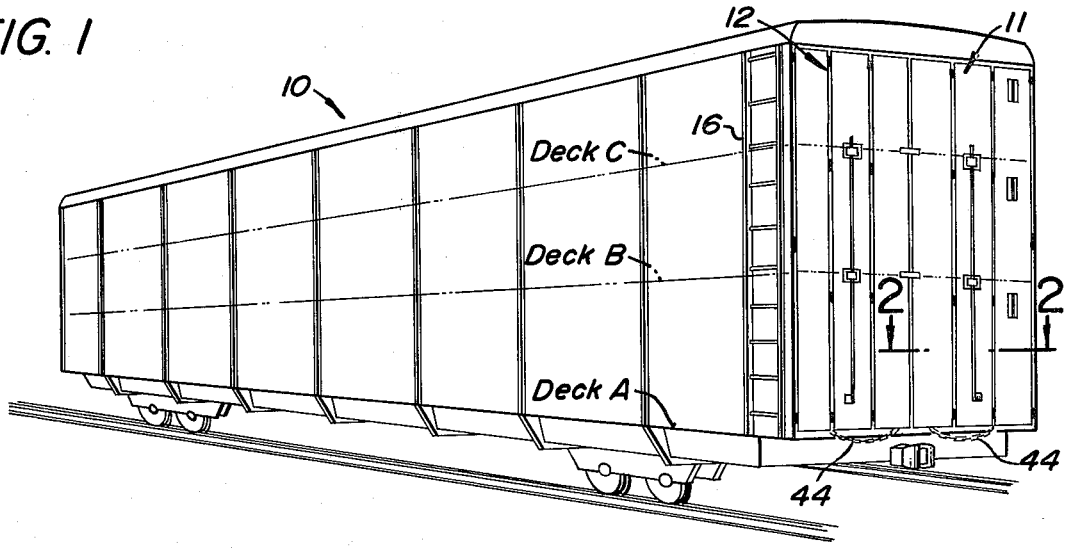
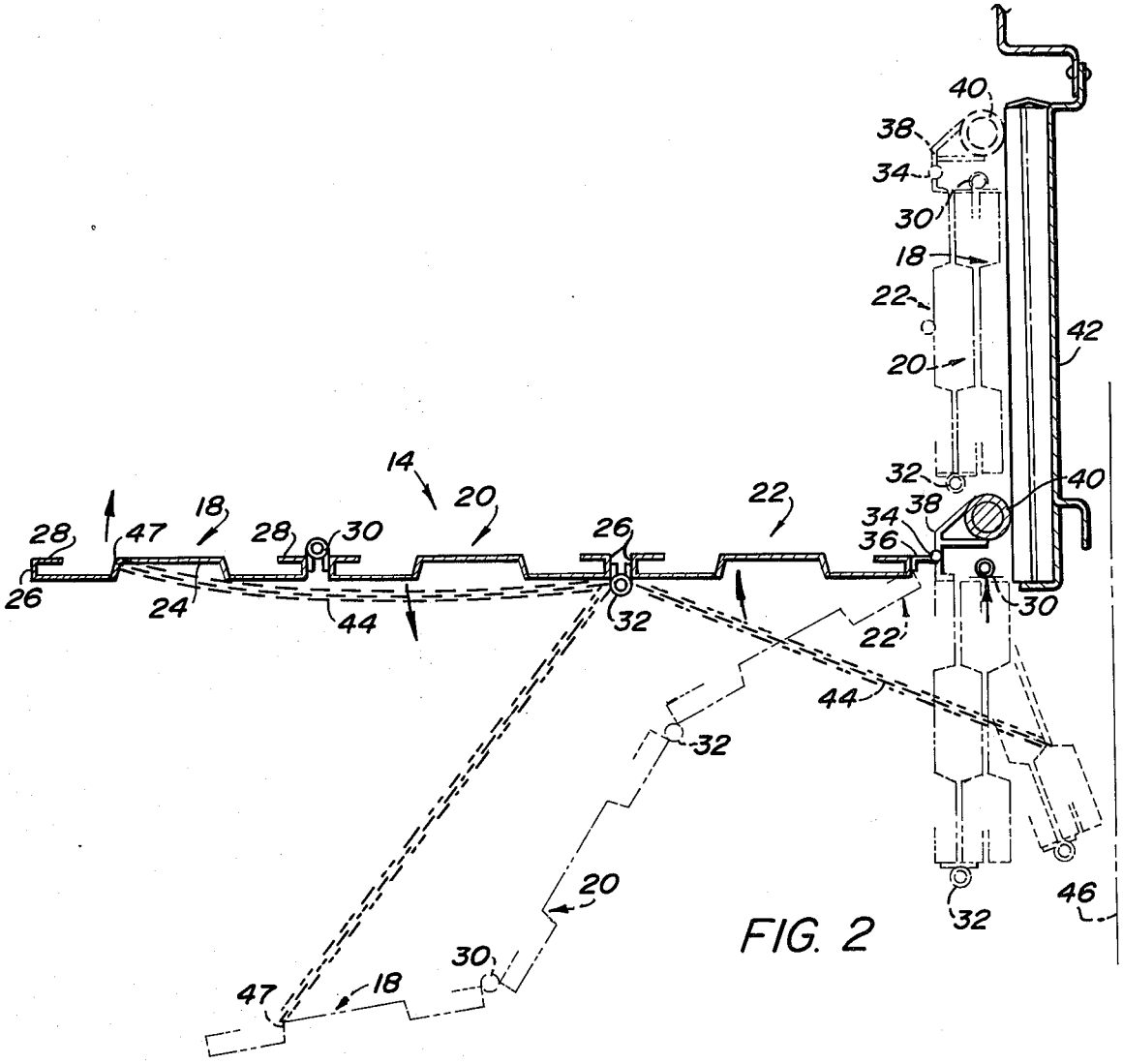
FIG. 2

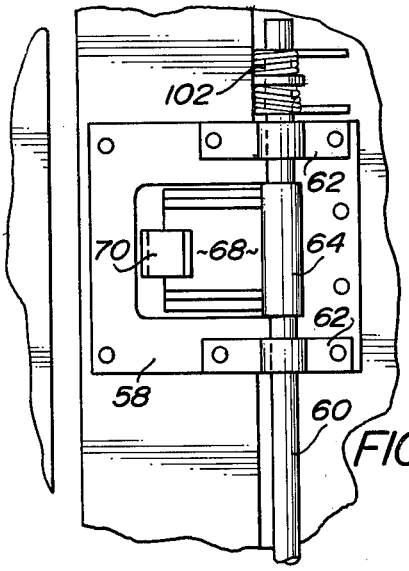
FIG. 4
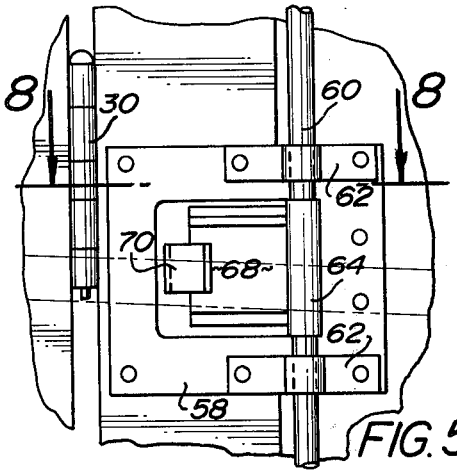
FIG. 5
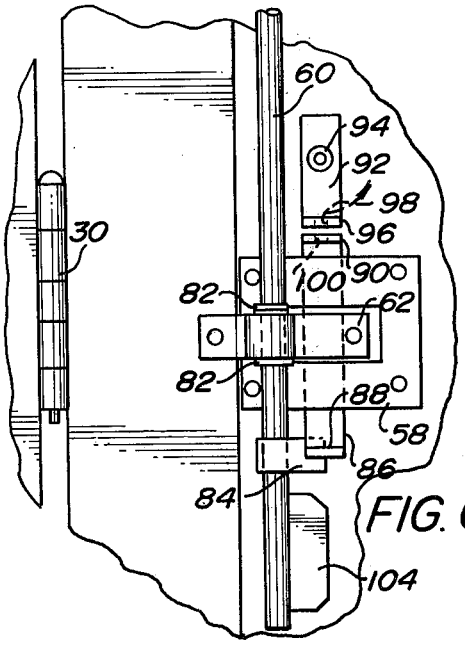
FIG. 6
FIG. 3
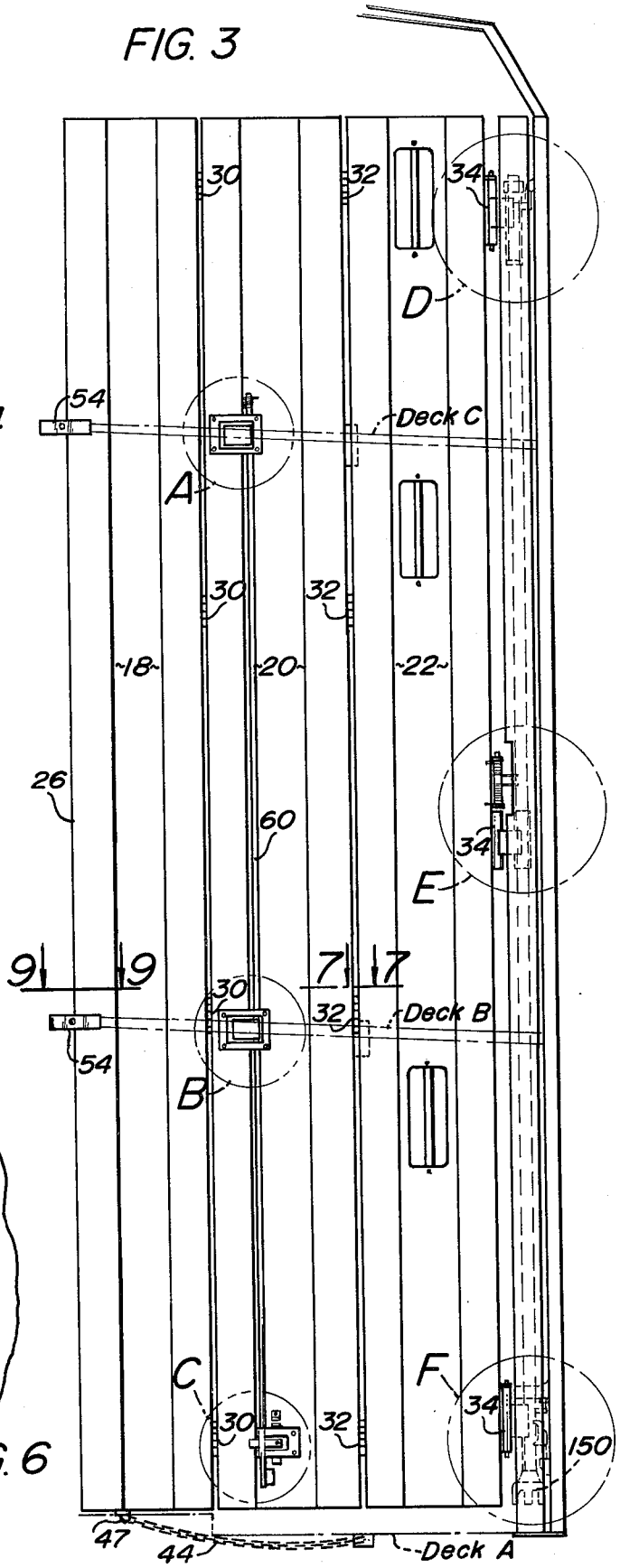

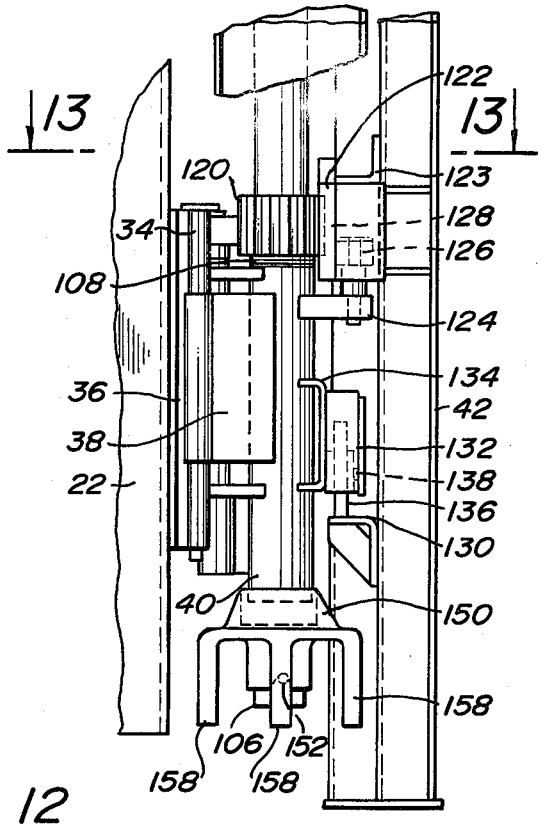
FIG. 12
FIG. 13
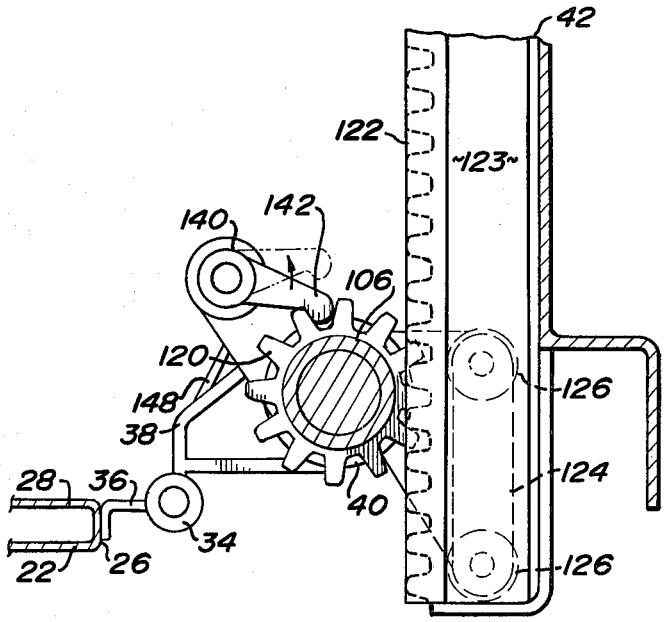

DOOR ASSEMBLIES FOR CLOSING RAIL CAR END OPENINGS

BACKGROUND OF THE INVENTION

Broadly, it has been known that by using bi-folded doors, the ends of decked automobile transit rail cars can be closed. There has been a problem, however, that when the cars are opened, the doors can get outside the clearance diagram and be easily damaged. The doors should be able to be opened when the cars are coupled for access to the interior of the rail car and the lading. Also, when the operator has delivered an automobile to an upper deck, he must be able to reach a ladder; therefore, he must be able to get around the folded and stored door panels. After the car is loaded, the door must be operable from the ground; and, of course, the door must not jam when it is going into or out of storage.

The rail car of the present invention, with its novel door assemblies and door arrangements, can solve all of these problems as well as providing a positive lock of the doors in the folded back and stored condition. This is made possible by the use of three panels, which are pivoted on their marginal edges for swinging relative to each other. Two sets of the three panels are used to close and lock the opening. The panels fold back upon themselves on hinges along their edges and are pivotally mounted adjacent to the outer sides of the opening on means which permit them each to move as a folded three-panel unit into the interior of the car to stored condition, where they may be positively locked and automatically unlocked from the stored position selectively. The mechanism for accomplishing these desirable ends will be described in the Brief Description Of The Invention to follow.

BRIEF DESCRIPTION OF THE INVENTION

The invention involves a rail car having an interior cavity defined partially by rail car side walls and an end opening for loading and unloading lading such as vehicles. Two door assemblies, each including a set of three panels are provided for closing the end opening. Each of the sets of panels closes one-half of the opening and folds upon the other panels of the set by means of hinges at the edges thereof for storage. The sets of door panels are each pivotally mounted adjacent the sides of the opening by means which can move on a track toward and away from the intermediate portion of the car to permit storage of the sets of folded panels along said rail car side walls.

The means for moving the pivot means includes a guide means in the form of a pair of rack and co-operating pinions drivingly mounted on a common manually driven shaft. One each of the pinions co-operates with racks adjacent the top and bottom portions of the set on the side walls of the rail car to keep the top and bottom portions of the set in register during travel along the track extending toward the intermediate portion of the car from the opening and upon which the door sets are supported for movement to and from the storage position. Each of the sets of panels are spring-biased in the direction of the closed as opposed to the open position.

The rail car has a plurality of horizontally disposed interior decks, each having cutouts and L-shaped cam clips mounted on the edge of the decks adjacent the end opening. Each set of door panels has mating, fixedly mounted latches to engage the cutouts and rotating latches to move behind a leg of the L-shaped cam clips to provide a preliminary locking to hold the panels against the edges of the interior decks. In addition, the middle of the deck edges at each level are provided with T-shaped cam clips, behind which the adjacent panel edges of the two panel sets lock against the deck.

The pivoted latches of each set are fixed on a common locking shaft which includes a locking flange so that an interference member, which is mounted for limited vertical movement, can be moved down in front of the locking flange to trap it between the door assembly and the interfering member thereby preventing rotation of the pivoted or final latches. A sealing lug pivots into position over the interference member to prevent its upward movement and to provide a place for sealing to insure that the car has not been opened during transit. The final and positive locking of the pivotally mounted latches is accomplished by having them arranged to cam in unison behind the L-shaped cam clips as the adjacent panel edge of the two sets are manually pushed into edge-to-edge relationship behind the T-shaped clip.

The shaft upon which pinions for alignment purposes are mounted have power wheels or cranks on the lower ends thereof. As each of the shafts are turned by means of its respective power wheel, a pawl rides over the teeth of a pinion until the door set is in stored condition along a side wall of the car. The power wheel drives by means of a projection on the shaft acting against a driving cam surface portion on the power wheel. An angular portion of the same cam surface is provided so that as the door is pulled out of the storage position, the power wheel moves axially, and in so doing, automatically removes the pawl from the teeth of the pinion by means of the outer top cam surface in driving connection with the pawl. Without this axial movement, of course, the pawl holds the pinions from moving on the rack and, therefore, holds the door set in its stored position. A chain or other tether is also provided so that the door set cannot swing beyond the clearance diagram. A lever may be provided for manual operation of the pivoted latch shaft.

DESCRIPTION OF THE DRAWINGS

FIG. 1 is a prospective view of a rail car constructed according to the principles of this invention.

FIG. 2 is a partial cross-sectional view taken along the lines 2—2 of FIG. 1 showing the different door panel positions in phantom.

FIG. 3 is an end elevational view of one-half of the rail car of FIG. 1.

FIG. 4 is an enlarged fragmentary view of Area A of FIG. 3.

FIG. 5 is an enlarged fragmentary view of Area B of FIG. 3.

FIG. 6 is an enlarged fragmentary view of Area C of FIG. 3.

FIG. 12 is an enlarged fragmentary view of the Area F of FIG. 3.

FIG. 13 is a cross-sectional view taken along the lines 13—13 of FIG. 12.

DETAILED DESCRIPTION OF AN EMBODIMENT OF THE INVENTION

Figure 7:
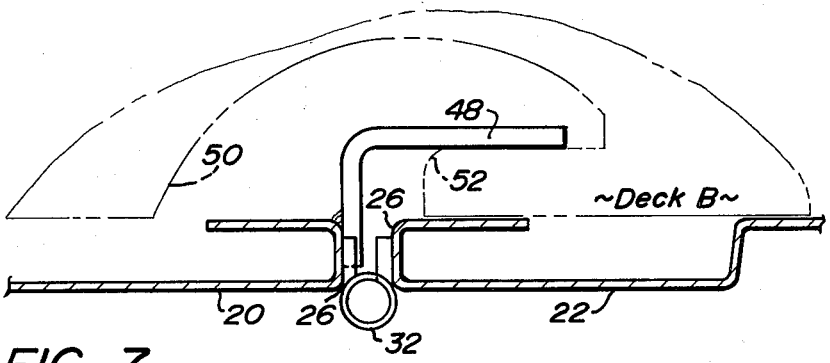
FIG. 7 is a cross-sectional view taken along the lines 7—7 of FIG. 3.
Figure 8:
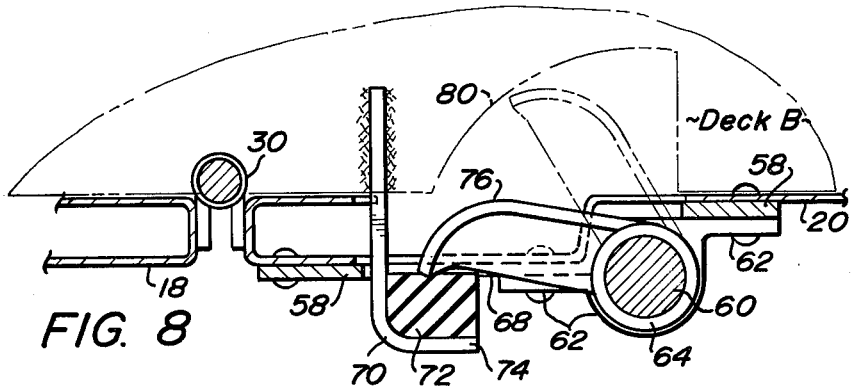
FIG. 8 is a cross-sectional view taken along the lines 8—8 of FIG. 5.

In the embodiment illustrated, the numeral 10 generally designates a rail car.

The rail car 10 has an end opening which has its left-hand half closed by a three-paneled door set 12 and its right-hand half closed by a three-paneled door set 14. The door panel sets 12 and 14 can be termed "tri-fold" door assemblies. On the side of the car adjacent the tri-fold door assembly 12 is a ladder 16. Car 10 is of the closed three-tier automobile transport type, including three decks into which ladings such as vehicles are stored for transit. The ladder 16 provides access to the upper decks.

The decks are generally known in the railroad industry as Decks A, B, and C, with Deck A being the lowermost deck and Deck C being the uppermost deck. As seen in FIG. 2, wherein the door panel set 14 is illustrated, the doors are capable of assuming many positions. In the illustrated full view position of FIG. 2, the door panel set 14 is closed. The tri-folded storage position within the car is shown in phantom, as is the tri-folded open position, and the partially extended open position. It will be seen from FIG. 1 that when, in the stored position, the door panel set of door assembly 16 which is the mirror image of set 14 will permit an operator on upper Decks B and C to bypass the folded back and stored doors and reach around to the ladder 16 for leaving the car. A description of the nature of the door assembly and how the positions illustrated in FIG. 2 are accomplished will accordingly follow.

Referring to door panel set 14 in FIG. 2, panels 18, 20, and 22 will be seen in a full top edge view in the closed position. Panels 18, 20, and 22 are made of 16 gauge metal. The panels all have an elongated vertical reinforcing rib 24 formed therein and all of the panel edges 26 have an inwardly extending flange 28 for further stiffening purposes. The adjacent edges 26 of the three panels 18, 20, and 22 have hinges welded thereto. The panels 18 and 20 have an inwardly disposed hinge 30 with leaves welded to their respective and adjacent edges 26, and the panel 22 and the adjacent edge of panel 20 have an outwardly extending hinge 32 similarly welded to the adjacent edges 26 of these panels. Panel 22 has a hinge 34 with an L-shaped leaf 36 welded to panel edge 26, and an angular Y-shaped leaf 38 fixedly mounted by welding to a pipe section 40. The hinge or pivot 34 permits swinging of the three panels out to a position parallel to the wall 42 of the car and beyond to a position where a chain 44 is fully extended. The chain prevents movement of the panels past the clearance diagram line 46, which is the point beyond which no portion of the car may extend because of the roadbed clearance. The chain 44 is affixed to the door assembly adjacent the stiffening rib 24 of the panel 18 at a point 47 on the lower panel.

As seen in FIG. 2, as the door panels 18 and 20 are swung about an arc to the closed position, it will be seen that they assume less than a full line, edge-to-edge condition until just before they come to the fully closed position. Advantage is taken of this fact in locking the three-panel doors, and this action will be described in connection with FIG. 3 and its associated figures.

In FIG. 3 it will be seen that the panels 18, 20, and 22 are illustrated in the fully closed position. Between the adjacent panel edges 26, the panels have a plurality of hinges along their length. For instance, between the panels 18 and 20 there are four hinges 30; between the panels 20 and 22, there are four hinges 32; and between the pipe 40 and the panel 22, there are three hinges 34. As the hinge 30 swings through its 90° from the open position to the closed position in closing of the door, the hinges 32 and 30 do not swing their full 180°. Thus, the condition shown in phantom in the lower portion of FIG. 2 exists until the panel 22 comes fully into engagement with the edges of the Decks B and C. As will be seen in FIG. 7, the panel 22 is held in engagement with Deck B, by a fixedly mounted latch 48. The latch 48 is mounted on the edge 26 of the panel 20 below the leaf of hinge 32 welded to that edge. The latch 48 extends inwardly for a distance and then parallel to the inner surface of the panel 22 but spaced therefrom. As the hinge 32 finishes its entire 180° of swing and the panel 20 comes into engagement with the Deck B, the fixed latch 48 enters a cutout in the edge of Deck B, shown in phantom, to be outlined by a surface 50. This moon-shaped cutout has a re-entrant portion 52 in the edge of Deck B such that the latch means 48 preliminarily locks the panels 20 and 22 against the Deck B edge. The shape of the cutout 50 and reentrant portion 52 is such that the surfaces of latch 48 can enter this locking engagement just as the full 180° of pivot travel of the hinge 32 is completed. With the fixed latch 48 being welded to the edge 26 of the panel 20, which is adjacent to the panel 22, these panels are preliminarily held until the final locking operation can be accomplished.

Figure 9:
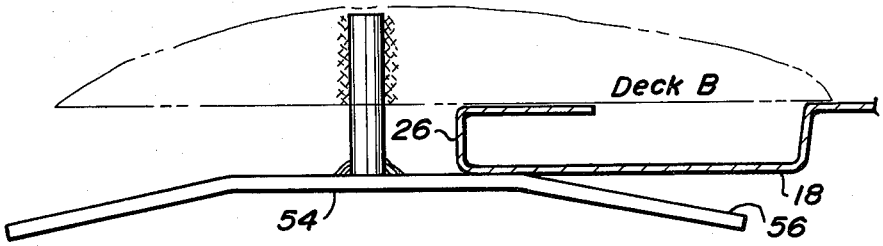
FIG. 9 is a cross-sectional view taken along the lines 9—9 of FIG. 3.

Before the final locking operation occurs, the leading edge 26 of panel 18 comes into contact with T-shaped cam clips 54 mounted by welding to the edge of Decks B and C. As best seen in FIG. 9, the T-shaped cam slips 54 have outwardly angled surfaces 56 on the wings of the tee which permit the edge 26 of the panel 18 to come into engagement between the Deck B and wing 56 of the cam clip. Thus with the edge 26 held by the T-shaped cam clip 54 and the preliminary locking being accomplished with fixed latch 48 behind reentrance portion surface 52 of the cutout 50, the three-door assembly is in condition for final locking.

As will be seen in Areas A, B, and C of FIG. 3 and FIGS. 4, 5, and 6, which are enlargements thereof, three openings are provided in the panel 20. The edges of the openings are appropriately stiffened by reinforcing frames 58. Running vertically across each of these framed openings is a pivotally mounted locking shaft 60 which is journaled behind a plurality of mounting straps 62. At Areas A and B, as shown in FIGS. 4 and 5, there are within the framed panel openings, rigidly mounted to the shaft 60, final locking cams 64. The final locking cams 64 have a generally cylindrical portion surrounding shaft 60, and fixedly mounted thereon, and a laterally or transversely extending cam lobe or latch member 68.

Mounted on the deck, extending out over the edge, is an L-shaped cam clip 70 with an elastomeric portion 72 of a material such as polytetrafluoroethylene, behind the outermost leg 74 thereof. The locking cam projection 68, being fixedly mounted on pivoting shaft 60, is provided with a rear surface 76 which can act against a cutout 80 in Deck B to cam itself into position. The force for doing this is applied manually to the outside of panels 18 and 20 in such a manner that as the panels come into contact with the Deck B, the camming projection behind the elastomeric block 72 into locking position. Because the camming locks 64 are rigidly mounted on the shaft 60, they move in unison into pockets 80 in the edge of both Decks B and C. The elastomeric material 72 acts both as a vibration dampener and a wear pad to assure a positive locking engagement and a minimum of vibration of the door assembly during transit of the rail car.

It will be seen that Area C has a cutout in door panel 18 adjacent to which the final locking shaft 60 extends, and a strap 62 in which the shaft is journaled. It will be noted in FIGS. 4 and 5 that because of the greater diameter of the portion 64 in the locking cam 68 than the journaled portion of the strap 62 that there can be no actual shifting of shaft 60. However, fillers and thrust washers 82 surround journal strap 62 in the Area C to perform the same function of holding the rod 60 against actual movement. Fixedly attached to the locking shaft 60 is a locking flange 84. The locking flange 84 rotates with the shaft 60 as it drives the camming portions 68 behind the L-shaped cam clips 70. When the final locking occurs and the locking cam 68 is behind the L-shaped cam clip 70 and its elastomeric material 72, the locking flange 84 extends laterally away from the shaft 60, parallel to panel 20 and adjacent thereto.

An interference member or lock bolt 86 is mounted for limited vertical movement by means of the reinforcing members 58 and straps 62. The interference member 86 has flanges 88 and 90 which limit its travel in the vertical direction, but within those limits, it is free to move into a position just outside of and adjacent to locking flange 84. Thus the locking flange 84 may be held in position between the panel 20 and the lower end portion of interference member 86.

At the top end of interference member 86, when it has fallen by gravity to the lowermost position, and adjacent to the flange 90 in face-to-face engagement, is a seal block 92. The seal block 92 pivots about a member 94 into and out of the vertical path of the interference member 86. The interference member 86, being naturally at its lowest point of limited travel from gravity, thus is out of the way for the sealing block 92 to pivot, by means of gravity, into its path. The seal block 92 has a flange 96 which then is in face-to-face engagement with the upper flange 90. With these two flanges in face-to-face engagement, apertures 98 and 100 come into alignment respectively for passage of a sealing wire to provide a manner of sealing the car to be sure, upon its arrival at its destination, that it has not been opened and tampered with.

In order to return the shaft 60 to unlock the car, the seal must be broken between flanges 90 and 98. The sealing block 92 pivots about pivot 94 and the interference member 86 moves upwardly to clear the locking flange 84 for rotation. Once it is free to rotate, because it is fixedly mounted on locking shaft 60, the shaft 60 can rotate, and the locking cams 64 are free to move out from behind the L-shaped cam clips, thus freeing the locking cams or pivoting latches and permitting the panel 20 to move outwardly. As the panel 20 moves outwardly, the panel 18, because of its connection through hinges 30, moves its adjacent edge 26 outwardly and its leading or center edge 26 is permitted to come out from behind the portion of the leg 56 of the T-shaped cam clip. As this occurs, the hinge 34 is beginning its motion such that the fixed latching clip or latch 48 moves out from behind the re-entrance portion 52 of cutout 50 in Deck B freeing the panel 22 from Deck B. The folding back to the open position of the panels in face-to-face open position is then accomplished, and the doors can be moved into the storage position.

Thus having described the locking mechanisms illustrated in the embodiments of the invention, it should be noted that the movement of the shaft 60 during the locking operation is springbiased by means of a spring 102 which is best seen in FIG. 4. The spring 102 being welded at its ends to panel 20 biases cam latch members 68 in an open direction. In addition to the described manner of manually pushing on the doors to lock them, and for turning locking shaft 60 for unloading, a lever or grab plate 104 is provided on the lower end of shaft 60.

Figure 10:
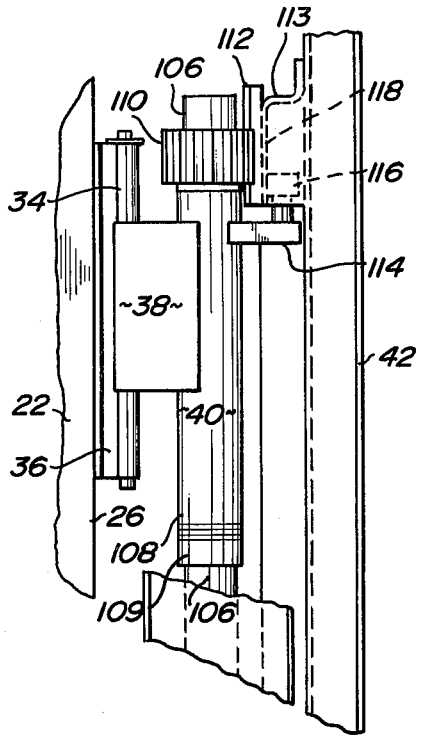
FIG. 10 is an enlarged fragmentary view of the Area D of FIG. 3.

Area D of FIG. 3, as detailed in FIG. 10, illustrates the manner by which the top portion of the three-panel door assembly 14 is mounted to the car. The panel 22 and the hinge 34 associated with its edge 26 will be seen in the left-hand portion of FIG. 10. The pipe section 40 to which the Y-shaped leaf 38 of hinge 34 can be seen with the Y-shaped leaf 38 welded thereto.

A pinion shaft 106 is journaled within the pipe section 40 and is shown with thrust bearings 108 thereabout and pipe stop ring 109 rigidly mounted to the shaft 106. The upper end of shaft 106 has rigidly attached thereto, the pinion 110. Pinion 110 rotates with shaft 106 by means of its mounted relationship within the pipe 40 and the teeth thereof engage a rack 112. The rack 112 is a forged piece of metal and is mounted on a rack support plate 113 running parallel to the wall of the car horizontally and into the interior of the car.

The pipe section 40 is supported in position and holds the journalled shaft 106 in position by means of a crank plate 114 and a roller 116 mounted thereon for travel along a retaining guide way 118 mounted behind the rack 112.

Figure 11:
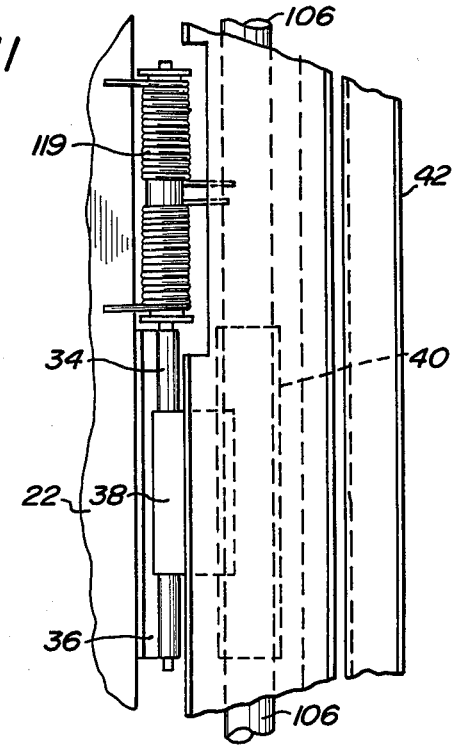
FIG. 11 is an enlarged fragmentary view of the Area E of FIG. 3.

FIG. 11 shows Area E of FIG. 3 in detail and illustrates the intermediate portion of shaft 106 with centrally located hinge 34. The spring 119 is biased to rotate panel 22 about hinge 34 toward the closed portion with the three folded panels 18, 20, and 22 as seen in phantom in the lower portion of FIG. 2.

Figure 14:
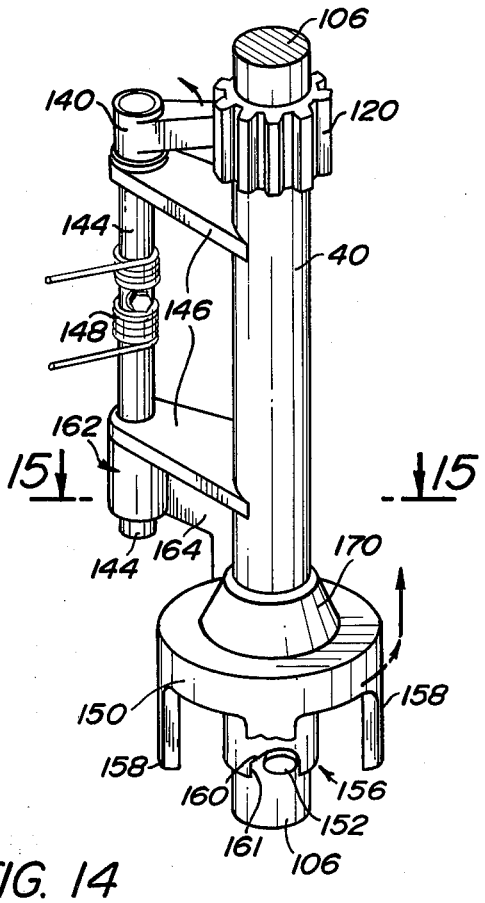
FIG. 14 is a pictorial view of the mechanism of FIGS. 12 and 13 with the hinges and wheels eliminated to clarify the view.
Figure 15:
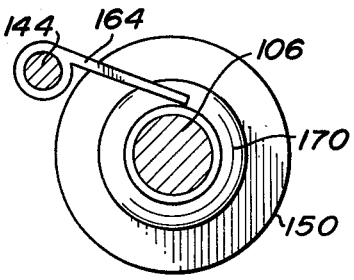
FIG. 15 is a view taken along the lines 15—15 of FIG. 14.

FIG. 12 shows Area F of FIG. 3 in detail and illustrates the lower portion of door assembly 14's support and guide means. It should be viewed in conjunction with FIG. 13, which is a cross-section on the line 13—13, FIG. 14, which is a pictorial view of the same structure, and FIG. 15 a cross-section thereof.

A previously pointed out, shaft 106 is a vertically extending shaft which has pinion 110 at its top. A similar pinion 120 is mounted rigidly with regards to shaft 106 and co-operates with a rack 122. The rack 122 is coextensive and parallel to rack 112 and because the pinions 110 and 120 are commonly mounted on the opposite ends of shaft 106, the top and bottom portions of door assembly 14 remain in register at all times and in particular during movement to and from the stored position at the inner end of racks 112 and 122. A rack support plate 123, similar to plate 113, supports rack 112.

Pipe section 40 to which lower hinge 34, through its Y-shaped leaf 38, is attached is separated from pinion 120 by thrust bearings 108. A crank plate 124 is provided with rollers 126 mounted thereon for travel along a retaining guideway 128 behind the rack 122.

Horizontally mounted below the rack 122 adjacent lower pipe section 40 is a track 130 which extends from the car opening to the interior of the car along wall 42. A fabricated plate roller cage 132 is mounted by means of welded bracket 134 to lower pipe section 40. A roller, mounted on pin 138 movably supports the trifold door assembly 14 for movement along track 130 to and from the storage position. The shaft 106 and pinions 110 and 120 maintaining the top and bottom in register by co-operation with their respective racks 112 and 122.

The pinion 120 is engaged by a pawl 140 which acts to positively lock the pinion in the storage position at its innermost end of travel on the rack 123. Because of the shape of the end portion 142 of pawl 140, the pawl slides over the teeth of pinion 120 as it rotates along rack 122 into storage position. Unless end portion 142 is rotated on pawl shaft 144 out of engagement with the pinion, however, reverse rotation is impossible.

Shaft 144, on which the pawl 140 rotates, is journalled in two plates 146 which extend laterally outwardly from, and are welded to, lower pipe section 40. A spring 148 biases the shaft 144 so that pawl portion 142 normally prevents rotation of pinion 120 for outward movement of door assembly 14.

The shaft 106 is manually driven by crank means in the form of a power wheel 150. A projection in the form of a pin 152 is mounted adjacent the end of shaft 106 for driving connection between the wheel 150 and shaft 106 on which it is mounted. Upon rotation of power wheel 150 to move the folded door assembly 14 into the storage position along racks 112 and 122, and track 130, a cam surface portion 156 drivingly cooperates with pin 152 to drive shaft 106. When all the way into the car interior in the storage position, the pawl 140 locks the doors in that position.

Upon desiring to move the folded door package 14 out of the storage position, the operator grasps one of the crank handles and pin 152 engages cam surface portion 160 of the wheel. Because of the angular shape of surface 160, the power wheel 150 is moved axially upwardly along the shaft 106 for a limited distance as it rotates. At the end of its travel in said limited distance pin 152 engages a second cam surface portion 161 such that a positive driving connection between power wheel 150 and shaft 106 is re-established for continued outward driving of the door assembly 14.

Mounted on the lower end of pawl shaft 144 for rotation therewith is a cam follower 162. Cam follower 162 has a laterally extending portion 164 in engagement with surface 170 of power wheel 150 acting on cam surface 160, surface 170 rotationally drives portion 164 radially away from shaft 160. This action automatically drives shaft 144 and pawl 140 away from pinion 120, thereby freeing door assembly 14 for movement outwardly along rack 122 from the stored position to the open position.

Having described the illustrated embodiment, we wish to state that it is not our intention to be limited thereto, but to be limited rather only by the scope of the appended claims.

What is claimed is:

1. In a rail car having an interior cavity defined partially by rail car side walls and an end opening for loading and unloading lading:

a door assembly including panels for closing at least a portion of said end opening, pivoted mounting means for moving said door assembly between an open position and a closed position, means including guide means for moving said pivoted mounting means transversely in directions toward and away from the intermediate portion of said rail car to permit storage of at least a portion of said door assembly along said rail car side wall and means for selective removal of said portion therefrom.

2. The rail car of claim 1 wherein means are provided to limit the maximum open position of said door assembly to a position substantially normal to said closed position and within the desired clearance diagram for said car.

3. The rail car of claim 1 wherein said door assembly includes a plurality of panels each movable with respect to the other.

4. The rail car of claim 3 wherein the panels are connected at adjacent edges for pivotal movement.

5. The rail car of claim 4 wherein said panels are spring biased to at least one of said positions.

6. The rail car of claim 1 wherein said door assembly includes a plurality of panels each movable with respect to the other and the length of transverse travel of said pivoted mounting means along said guide means is within said car and is sufficient to permit storage of all of said panels within said car when the pivoted mounting means are within said rail car in their maximum position of travel in the direction toward the intermediate portion of the rail car.

7. The rail car of claim 1 wherein said guide means includes alignment means to maintain the top and bottom portions of said door assembly in register regardless of the position of the pivoted mounting means with respect to the intermediate portion of the rail car.

8. The rail car of claim 1 wherein the means for moving said pivoted mounting means toward and away from the intermediate portion of said rail car includes in addition to the guide means, at least one track which extends normal to said opening and upon which said door assembly is movably supported.

9. The rail car of claim 1 wherein said guide means includes at least one shaft mounted pinion and a cooperating rack.

10. The rail car of claim 9 wherein the shaft upon which the pinion is mounted is manually driven by a power wheel.

11. The rail car of claim 10 wherein the power wheel includes a first cam surface having a driving portion and said shaft has a projection for engaging said driving portion when the power wheel is rotated to drive the shaft and pinion and move said door assembly along said rack in a direction toward the intermediate portion of the rail car.

12. The rail car of claim 11 wherein said pinion is engaged by a locking means and the first cam surface of the power wheel includes an angular portion which when engaged by the projection on the shaft during initial movement of the door assembly along said rack away from the intermediate portion of the rail car, drives the power wheel axially relative to the shaft, said axial movement disengaging the locking means from the pinion to permit said door assembly to be driven out with the pinion freely running on the rack.

13. The rail car of claim 10 wherein the pinion is engaged by a force biased pawl, said pawl having a first surface portion such that during rotation of the pinion in a first direction as said door assembly moves toward the intermediate portion of the rail car said first surface portion of the pawl rides over the teeth of the pinion until said pivoted mounting means are within said rail car in their maximum position of travel in the direction toward the intermediate portion of the rail car, and a second surface portion such that when the pawl is in its force biased condition said second surface portion engages the pinion teeth and prevents movement of the pivoted mounting means in the direction away from the intermediate portion of the rail car by preventing the pinion from rotating in a second and opposite direction thereby holding the door assembly in storage position until such time as the pawl is moved against its force bias out of engagement with the pinion.

14. The rail car of claim 13 wherein the power wheel has a second cam surface and the pawl is drivingly connected to a cam follower in engagement with said second cam surface such that said axial movement of said power wheel drives said cam follower and thereby said pawl drivingly connected thereto against said force bias thereby to free said pinion of said pawl to permit said pinion to rotate in said rack in a second and opposite direction of said one direction and thereby to permit said pivoted mounting means and door assembly to move in the direction away from the intermediate portion of said car, but out of the storage position.

15. The rail car of claim 14 wherein the force bias acting on said pawl is a spring.

16. In a rail car having an interior cavity and an end opening for loading and unloading lading:

a door assembly including a plurality of panels each pivotally movable with respect to the other for closing at least a portion of said end opening, mounting means including pivot means for moving said door assembly between an open position and a closed position, means for moving said mounting means toward and away from the interior of said rail car to permit storage of at least a portion of said door assembly within said rail car, said means for moving said mounting means including guide means in the form of a pair of rack and co-operating pinions mounted on a common manually driven shaft, one each at the top portion and the bottom portion of the door assembly to keep said portions in register, said means for moving said mounting means further including at least one track which extends normal to said opening and upon which said door assembly is movably supported.

17. In a rail car having an interior cavity and an end opening for loading and unloading lading;

a door assembly including a plurality of panels each pivotally movable with respect to the other for closing at least a portion of said end opening, mounting means including pivot means for moving said door assembly between an open position and a closed position, means for moving said mounting means in a straight line toward and away from the end opening of said rail car to permit storage of at least a portion of said door assembly along said rail car side.

18. The rail car of claim 17 wherein the plurality of panels are spring biased in the direction of the closed position.

19. The rail car of claim 17 wherein the opening has a portion bounded by a horizontally disposed member with at least one re-entrant cutout in its marginal portion adjacent the opening, at least one fixedly mounted latch mounted on one of said door panels for movement into said cutout and behind an adjacent portion of said member to lock said panel against said member in closed position.

20. The rail car of claim 19 wherein a plurality of said horizontally disposed members are defined by the edges of interior decks within said rail car, each of said edges having at least one of said cutouts and said assembly having a plurality of said fixedly mounted latches positioned for movement into a correspondingly positioned cutout, said fixedly mounted latches being mounted for movement in unison into said cutouts to lock said door assembly.

21. The rail car of claim 20 wherein the shape and relative positions of the cutouts and latches are such that the latches engage and enter the cutouts upon manual forcing of said door panel into closed position.

22. The rail car of claim 17 wherein the opening has a portion bounded by a horizontally disposed member with at least one projecting generally L-shaped cam clip with the planes defined by the legs of the L being oriented in a generally horizontal direction adjacent said opening, at least one pivotally mounted latch mounted on one of said door panels for movement behind one of the legs of said L-shaped cam clip to lock said panel against said member in closed position.

23. The rail car of claim 22 wherein a plurality of said horizontally disposed members are defined by edges of interior decks within said rail car, each of said edges having at least one of said L-shaped cam clips and said door assembly having a plurality of said pivotally mounted latches positioned for movement behind a correspondingly positioned L-shaped cam clip, said pivoted latches being mounted upon a common pivotally mounted shaft for movement in unison behind said L-shaped cam clips to lock said door assembly.

24. The rail car of claim 23 wherein the pivotally mounted shaft has a lever attached thereto to provide pivotal selective rotation of the shaft.

25. The rail car of claim 23 wherein the shapes and the relative positions of the L-shaped cam clips and latches cam-shaped surfaces are such that said pivotally mounted shaft is rotationally driven toward the locked position as the latches engage and move behind one leg of the L-shaped cam clip upon manual forcing of said door assembly into closed position.

26. The rail car of claim 23 wherein the pivotally mounted shaft has a lock flange fixedly attached thereto and projecting transversely thereof, an interference member mounted for selective limited vertical movement on a door panel adjacent to said lock flange and spaced from door panel by a distance sufficient for a portion of said lock flange to be received between said interference member and said door panel when said interference member is in its lowest position, a pivoted lock block means mounted to swing by gravity into the vertical path of said interference member as it rests by force of gravity in its lowest position, whereby rotation of said shaft to unlock said door can be accomplished only by pivoting said block means and moving the interference member upwardly out from in front of the lock flange thereby to free the lock flange and therefore to permit the pivotally mounted shaft to rotate to the unlocked position with said latches cleared from behind said L-shaped cam clips.

27. The rail car of claim 22 in which the L-shaped cam clips have an elastomeric vibration dampening and wear resisting material on the backside of the leg of the L behind which the latch moves to provide the locking function.

28. The rail car of claim 17 wherein the opening has a portion bounded by a horizontally disposed member with at least one projecting generally T-shaped cam clip with the planes defined by the legs of the T being oriented in a generally horizontal direction adjacent said opening, at least one panel edge being shaped and dimensioned for movement behind one of the legs of said T-shaped cam clip to lock said panel against said member in closed position.

29. The rail car of claim 28, wherein a plurality of said horizontally disposed members are defined by edges of interior decks within said rail car, each of said edges having at least one of said T-shaped cam clips, at least one panel edge being shaped and dimensioned for movement in unison behind one of the legs of each of said T-shaped cam clips to lock said panel against said interior decks.

* * * * *